United States Patent [19]

Ramsey et al.

[11] Patent Number: 4,830,689

[45] Date of Patent: May 16, 1989

[54] BONDED METALLIC CABLE SHEATHING WITH EDGE FORMING

[75] Inventors: Rusty L. Ramsey, Moweaqua, Ill.; Frederick M. Zinser, III, Chester, S.C.

[73] Assignee: Essex Group, Inc., Fort Wayne, Ind.

[21] Appl. No.: 163,351

[22] Filed: Mar. 2, 1988

[51] Int. Cl.[4] ..... H01B 13/10

[52] U.S. Cl. ..... 156/54; 156/56; 174/102 D; 174/106 D; 428/582; 428/595

[58] Field of Search ..... 156/54, 56; 174/102 D, 174/106 D; 428/582, 595

[56] References Cited

U.S. PATENT DOCUMENTS

| | | | |
|---|---|---|---|
| 4,100,003 | 7/1978 | Trusch | 156/54 |
| 4,377,908 | 3/1983 | Pan | 156/54 X |
| 4,404,720 | 9/1983 | Bohannon | 156/54 X |
| 4,569,704 | 2/1986 | Bohannon et al. | 156/54 X |
| 4,778,543 | 10/1988 | Pan | 156/54 |

*Primary Examiner*—Robert A. Dawson

*Attorney, Agent, or Firm*—R. Thomas Payne

[57] ABSTRACT

A cable shielding system is disclosed wherein corrugated metal shielding has its edges bent to a predetermined configuration prior to being formed about the cable. Upon being formed around the cable, the sheathing with the pre-bent edges forms a closed passage way within the seam for receiving an adhesive. The pre-bent edge configuration reduces the possibility that the edge of the metallic sheathing will damage an externally applied plastic sheath.

20 Claims, 1 Drawing Sheet

FIG. 1 PRIOR ART
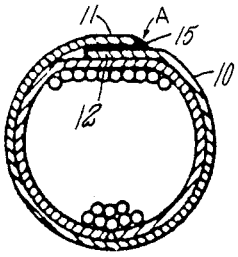
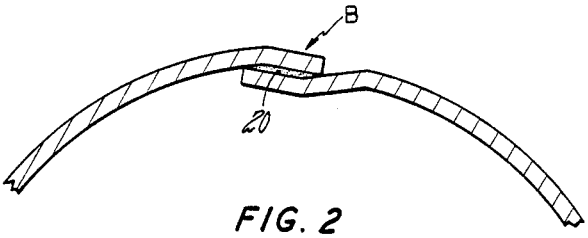
FIG. 2
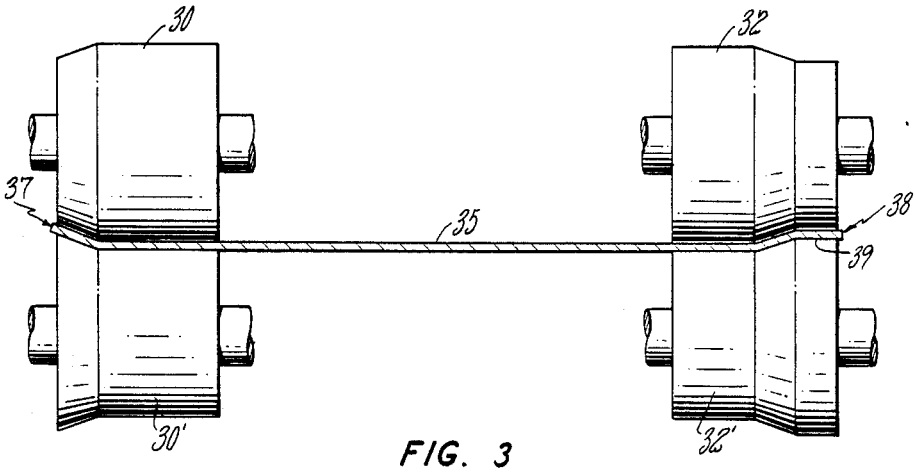
FIG. 3

BONDED METALLIC CABLE SHEATHING WITH EDGE FORMING

TECHNICAL FIELD

This invention relates to the field of shielded cable and to particular geometries for forming cable shields.

BACKGROUND ART

Electrical cables are essential for the transmission of information and power. Because electrical cables have widely differing performance requirements and must function in various adverse environments, a large amount of technology has been developed in the field of electrical cables.

In particular, in the field of telecommunications cables, which usually contain multiple insulate conductors, it is a common practice to surround the insulated conductors with one or more protective sheaths. Typically the outer sheath is seamless plastic composition which provides water proofing and electrical insulation. Immediately underlying this plastic sheath is a metal sheath which provides strength and resistance to external damage.

Some cable geometries employ a metal sheath which is not bonded at the overlapping seam or is only weakly bonded. Typically, the metal shield in such cases is aluminum. When a steel shield is used it may be bonded to the outer plastic sheath by using a steel sheath tape preform coated with a plastic material which has adhesion properties where contacted with the extruded plastic of the outer sheath. This form of cable is prone to "zippering" which occurs when the cable is sharply bent or twisted, there is relative movement in the metal sheath overlap and and the bonded metal sheath edge at the overlap cuts the plastic sheath penetrating it and/or the outer plastic sheath elongates to failure along the metal sheath seam.

FIG. 1 illustrates a typical prior art geometrical arrangement of metallic and plastic sheathing. In FIG. 1 the underlying metallic shield portion of the sheath 10 overlaps as shown in area A. The metal shield is bonded to itself at the area of overlap A and in the prior art patent from which FIG. 1 is taken (U.S. Pat. No. 4,477,298) the metallic shield is described as having an organic coating, applied to the metal strip from which the sheath is formed, which permits bonding between the metal and plastic sheaths.

As shown in FIG. 1 the adhesive 15 which bonds the metal sheath edges 11, 12 together, is placed between two essentially parallel portions of the metal sheath edges 11, 12 with no edge constraint on adhesive flow. This allows lateral flow of adhesive 15 which can flow both inwardly and outwardly of the seam overlap causing several problems. Avoidance of excessive lateral adhesive flow requires close control of the volume of adhesive applied and the correlation between the volume of adhesive applied and the distance between the sheath portions to be joined. The sheath joint configuration shown in FIG. 1 is produced by a forming method wherein a corrugated sheath preform is formed from a flat strip to a sheath without preliminary edge treatment.

The art has also appreciated that a protruding metal sheath edge can cut the external plastic sheath and has proposed bending the overlapping metal sheath edge so that it is less prone to cut the plastic sheath (U.S. Pat. No. 4,404,720). In general, edge forming as practiced by the art has not included edge forming of the metal sheath preform as a separate step prior to forming the preform about the cable and has not included preforming both edges of the sheath preform so that they cooperate to form an adhesive retaining cavity in the end product.

DISCLOSURE OF INVENTION

The present invention focuses on the outer metallic sheathing used on telecommunications cable, but is generally applicable to other types of cables as well.

According to the present invention, the corrugated metallic sheathing preform has its edges preformed, prior to being formed around the cable, so that upon being formed around the cable a seam is produced which contains a longitudinal recess to hold adhesive.

The foregoing and other features and advantages of the present invention will become more apparent from the following description and accompanying drawing.

BRIEF DESCRIPTION OF DRAWINGS

FIG. 1 shows a prior art edge geometry as described in U.S. Pat. No. 4,477,298.

FIG. 2 shows a sheath joint geometry according to the present invention.

FIG. 3 shows a roller geometry which can be used to pre-bend sheath edges for the practice of the present invention.

BEST MODE FOR CARRYING OUT THE INVENTION

The present invention uses standard starting material consisting of a corrugated metal tape having a typical thickness between 3 and 10 mils. This starting material may, for example, be obtained from the Dow Chemical Corporation under the trade name Zetabon. The width of the preform is, of course, selected based on the cable diameter and the thickness and corrugation details are selected based on the mechanical properties required in the finished cable. This corrugated tape usually has an organic coating, for example, ethylene acrylic acid, which promotes bonding between metal and plastic portion of the sheath.

A plastic sheath will be applied by extrusion over the top of the corrugated metal sheath, typical material is that as known in the trade as LPE supplied by the Union Carbide Corporation.

The essence of the invention is that the corrugated tape has its edges pre-bent or preformed to produce a particular seam geometry.

FIG. 2 shows the corrugated sheath material after it has had its edges preformed and after the metal sheath has been applied to the cable (the corrugations run in the short or transverse strip direction, corrugation details are omitted for clarity). The result of the invention is the production of a sheath joint B which contains a longitudinally extending recess 20 adapted to receive and restrain adhesive material which may be for example ethylene acrylic acid, supplied by the Dow Chemical Corporation. As shown in the FIG. 2 the sheath joint contains a longitudinally extending recess 20 having a generally trapezoidal shape, a shape which is effective in restraining excessive lateral adhesive spread. It can also be seen that the joint geometry produces a smooth exterior surface so that there is no sharp sheath edge to potentially cut or damage the exterior plastic sheath upon flexing during installation or use.

An important aspect of the invention is that the sheath preformed edges are deliberately bent in a predetermined, controlled fashion prior to the formation of the sheath about the cable. This edge is preformed using rollers as shown in FIG. 3. As shown in FIG. 3 two mating pairs of rollers 30, 30' and 32, 32' are employed. The two roller pairs have different contours. One set of rollers 30, 30' bends a portion of the first edge 37 at a moderate angle (30°–45°) relative to the major lateral section 35 of the sheath material. The other set of rollers 32, 32' bends the second edge 38 first upwardly at a slight lateral angle (15°–30°) relative to the central, undeformed portion 35 of the metal shield material and then bends the sheath edge in a reverse direction, at approximately the same angle, so that an outer lateral segment 39 of the sheath is essentially parallel to the central portion 35 of the sheath. Referring back to FIG. 2 it can be seen that these pre-bent edge portions cooperate to form a trapezoidal sheath joint having the desired laterally extending passage. The benefits of the invention can be obtained with various edge geometries, for example, instead of sharp bends continuous curvatures can be employed and such are within the scope of the invention. Notably, both edges are pre-bent prior to forming the sheath about the cable in contrast to the prior art where edge forming, if performed at all was performed during the sheath wrap operation and usually only one edge was formed.

The metallic sheath material is purchased smooth and corrugated transversely inline during processing. The edge forming rollers are smooth and the pre-formed edges and corrugations are not significantly flattened during processing. FIG. 3 omits the corrugation details for clarity.

Upon forming around the cable the transverse corrugations in the edges will overlap and register producing the result shown in FIG. 2. An equivalent result could be obtained using a flat strip and employing a set of rolls to both corrugate and edge bend the strip at the same time. FIG. 2 omits unnecessary internal cable details since the invention has application to many different styles and forms of cable.

A primary benefit resulting from the present invention is that the adhesive will be effective in bonding the sheath edges together but will not flow from the joint to cause bulges under the plastic sheath or cause internal bonding of other cable constituents. The bonded sheath of the present invention is effective in eliminating the zippering problem. In prior art cables, the underlying metallic sheath can rupture the outer plastic sheath if the cable is excessively flexed or twisted during installation.

Accordingly then, the present invention provides a method for forming metallic cable sheath in such a fashion as to produce an improved seal joint geometry by pre-bending the metal sheath edges prior to forming the sheath about the cable.

According to the present invention a corrugated metallic sheath preform material has its edges bent in a controlled fashion so that upon forming the sheath with the bent edges around a cable the bent sheath edges cooperate to form a joint which has a recess which is adapted to contain and restrain an adhesive material. While, the process and product herein described constitute preferred embodiments of the invention, it is to be understood that the invention is not limited to this precise process and product, and that changes may be made therein without departing from the scope of the invention which is defined in the appended claims

We claim:

1. In the method of producing shielded cable of the type having a longitudinally seamed corrugated metal sheath overlaid with a bonded extruded plastic sheath the improvement which comprises:

prior to encasing said cable with said corrugated metal sheath, preforming the edges of said corrugated metal sheath precursor strip so that upon the formation of the metal sheath, the longitudinal sheath seam includes a closed longitudinal recess adapted to receive an adhesive bonding agent, said recess being effective in containing said adhesive and said seam having a minimal tendency towards notch formation when the plastic sheath is applied.

2. A metal strip preform for forming a metal sheath about a cable, said preform having a longitudinal direction, being corrugated in the transverse direction and said preform having both longitudinally extending edges bend so that they cooperate to form a longitudinally extending recess when the metal strip having the preform is applied to the cable.

3. A shielded cable comprising:

at least one transmission means;

a metallic sheath means having preformed edges for enclosing said transmission means, said edges being preformed prior to said metallic sheath means enclosing said transmission means;

a longitudinal seam formed by the junction of said edges, said seam including a closed longitudinal recess for receiving and retaining an adhesive means therein, said recess being formed by the cooperation of said preformed edges;

adhesive means, operatively inserted into said recess between said preformed edges, for bonding said edges together; and a non-metallic sheath means, operatively connected to said metallic sheath means, for providing electrical insulation and water proofing, said seam having a minimal tendency towards notch formation when said non-metallic sheath mean is operatively connected to said metallic sheath means.

4. The shielded cable of claim 3 wherein said recess has a generally trapezoidal shape.

5. The shielded cable of claim 3 wherein said seam has substantially smooth exterior surface so that no sharp metal sheath edges are available to cut or damage the non-metallic sheath means upon said cable being flexed during installation or use.

6. The shielded cable of claim 6 wherein a first edge forming said recess in said metallic sheath means is bent at an angle of at least 30 degrees.

7. The shielded cable of claim 6 wherein a second edge forming said recess in said metallic sheath means is first bent at an angle of at least 15 degrees in the same direction as said first edge and is then bent in the reverse direction at an angle of at least 15 degrees so that an outer lateral segment of said metallic sheath means is essentially parallel to a center portion of said metallic sheath means.

8. The shielded cable of claim 3 wherein when flexed or twisted during installation, said metallic sheath means does not rupture said non-metallic sheath means.

9. The shielded cable of claim 3 wherein said adhesive means does not flow from said recess thereby essentially eliminating bulges between said metallic sheath means and said non-metallic sheath means.

10. The shielded cable of claim 3 wherein a first edge forming said recess in said metallic sheath means is bent at an angle of at most 45 degrees.

11. The shielded cable of claim 10 wherein a second edge forming said recess in said metallic sheath means is bent at an angle of at most 30 degrees in the same direction as said first edge and then is bent in the reverse direction at approximately the same angle.

12. The shielded cable of claim 11 wherein said first and said second edges cooperate to prevent the flow of an adhesive means from said recess.

13. A method for producing a shielded cable comprising the steps of:

providing at least one set of wire means;

enclosing the wire means in an insulation means;

providing metallic sheath means;

preforming the edges of said metallic sheath means;

surrounding said wire means with said metallic sheath means having said preformed edges;

joining said preformed edges to form a closed longitudinal recess for receiving and effectively containing an adhesive means; and extruding plastic sheath means over said metallic sheath means so that said wire means and said metallic sheath means are enclosed by said plastic sheath means.

14. The method of claim 3 wherein prior to the preforming step, said metallic sheath means is corrugated.

15. The method of claim 3 wherein said metallic sheath means is corrugated and then immediately preformed.

16. A shielded cable comprising:

transmission means;

insulation mean surrounding said transmission means;

a corrugated metal sheath for enclosing said transmission means, said metal sheath further comprising:

a first preformed edge bent at an angle of at least 30 degrees; and a second preformed edge first bent at an angle of at least 15 degrees in the same direction as said firt edge and then bent at an angle of at least approximately 15 degrees in the reverse direction, said first and said second edges forming a longtitudinal metal sheath seam having a closed longitudinal recess for effectively containing an adhesive means therein; adhesive means, operatively inserted into said recess, for bonding said edges together; and outer sheath means, extruded about said metal sheath, for providing electrical insulatinn and waterproofing.

17. The shielded cable of claim 16 wherein said metal sheath seam exhibits a minimal tendency to form notches under said outer sheath means.

18. The shielded cable of claim 3 wherein said adhesive means is operative to maintain at least said outer overlapped seam edge in contact with a surface of said metallic sheath means, said adhesive means limiting sliding between said overlapped edges during cable flexing thereby preventing said outer edge from penetrating said non-metallic sheath means to cut or notch said non-metallic sheath edge.

19. The shielded cable of claim 18 wherein said seam has a smooth exterior surface contacting said non-metallic sheath means.

20. The shielded cable of claim 18 wherein said outer edge is further prevented from elongating said non-metallic sheath to failure.

* * * * *